US010843099B1

(12) United States Patent
Pratt

(10) Patent No.: US 10,843,099 B1
(45) Date of Patent: Nov. 24, 2020

(54) TOY BUILDING BLOCK HAVING AN OPEN MULTI-CYLINDRICAL ENDPIECE

(71) Applicant: Jennifer Lynne Pratt, Owings, MD (US)

(72) Inventor: Jennifer Lynne Pratt, Owings, MD (US)

( * ) Notice: Subject to any disclaimer, the term of this patent is extended or adjusted under 35 U.S.C. 154(b) by 0 days.

(21) Appl. No.: 16/407,374

(22) Filed: May 9, 2019

(51) Int. Cl.
*A63H 33/08* (2006.01)
*A63H 33/04* (2006.01)

(52) U.S. Cl.
CPC ..... *A63H 33/084* (2013.01); *A63H 33/044* (2013.01)

(58) Field of Classification Search
CPC ..... A63H 33/084; A63H 33/044
USPC ..... 446/120, 124, 125, 126, 128
See application file for complete search history.

(56) References Cited

U.S. PATENT DOCUMENTS 1,531,542 A * 3/1925 Cogshall ..... A63H 33/084 434/172
3,554,236 A * 1/1971 Rhodes ..... A63H 33/065 138/117
3,576,936 A * 5/1971 Fischer ..... A63H 33/042 434/224
5,536,111 A * 7/1996 Doernemann ..... E02B 3/04 405/16
5,653,621 A * 8/1997 Yao ..... A63H 33/082 446/127
5,974,713 A * 11/1999 Wu ..... A47G 1/065 40/605
D590,789 S * 4/2009 Pozin ..... D14/126
9,038,834 B2 * 5/2015 Liu ..... A47B 47/0066 211/186
9,155,976 B1 * 10/2015 Mosquera ..... A63H 33/08
9,283,491 B2 * 3/2016 Pope-Gusev ..... A63H 33/008
10,086,304 B1 * 10/2018 LaChance, III ..... A63H 33/105
2007/0178799 A1 * 8/2007 Rudell ..... A63H 33/101 446/120

* cited by examiner

*Primary Examiner* — Nini F Legesse

(57) ABSTRACT

A toy building set is disclosed that describes a toy building set for constructing a doll house having a block with a rectangular base, a first end piece and second end piece such that the first end piece and the second end piece are rigid, stationary and permanently affixed to the base. The first building block attaches to a second building block by sliding the first end piece of the first building block into one of a set of three open cylindrical tubes of a second building block. The open cylinders are attached to a building block base at varying angles to create desired play structures.

10 Claims, 8 Drawing Sheets

302

TOY BUILDING BLOCK HAVING AN OPEN MULTI-CYLINDRICAL ENDPIECE

FIELD OF THE INVENTION

The present invention relates to toy building pieces. More specifically, the invention relates to the construction of a dollhouse using toy building pieces having an open multi-cylindrical end piece, a base and a singular closed cylindrical end piece.

BACKGROUND

For years, children have enjoyed constructing original structures using building pieces such as Legos, Tinker Toys and basic wooden blocks. Structures built using such pieces are limitless and can include miniature houses, tunnels and vehicles. Building temporary structures using these types of pieces allows a child to break down a structure and then build again using the same pieces.

Dollhouse construction typically involves wooden elements being permanently affixed to each other by an adult before a child can play with it. Once a dollhouse is built, the structure cannot be easily changed. Temporary dollhouse construction could be accomplished using building pieces such as Legos, however, angles at which the pieces are connected are limited using this type of block.

Currently, no building set exists that allows the construction of temporary dollhouses such that a child can easily build, disassemble and rebuild a dollhouse.

BRIEF SUMMARY OF THE INVENTION

The present invention includes a novel toy building set having building blocks with a base, a first end piece and a second end piece which are permanently affixed. The first end piece is a singular, closed cylindrical tube and the second end piece is a set of three open cylindrical tubes. A first building block attaches to a second building block by sliding the first end piece of the first building block into one of a set of three open cylindrical tubes of a second end piece of the second building block. The second end piece can receive at least one closed end piece from another building block. The diameters of the open cylindrical tubes are equivalent and the diameter of a closed cylindrical tube is less than the equivalent diameters of the open cylindrical tubes. The diameter of the closed cylindrical tube is smaller than the diameters of the inside of the open cylindrical tubes so that the closed cylindrical tube fits snugly when slid into an open cylindrical tube.

The toy building set includes a third building block having a base, a first end piece, a second end piece with three open cylindrical tubes and a closed cylindrical top piece. The top piece can be a closed cylindrical tube, such that building blocks can attach to each other along the top of a building block in addition to the sides. A fourth building block is described herein that consists of a set of one or more open cylindrical tubes, without a base or accompanying closed endpiece. This block is a detached endpiece to allow for more flexibility in building.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure.

In describing the invention, it will be understood that a number of techniques and steps are disclosed. Each of these has individual benefit and each can also be used in conjunction with one or more, or in some cases all, of the other disclosed techniques. Accordingly, this description will refrain from repeating every possible combination of the individual steps in an unnecessary fashion. Nevertheless, the specification and claims should be read with the understanding that such combinations are entirely within the scope of the invention and the claims.

Figure 1:
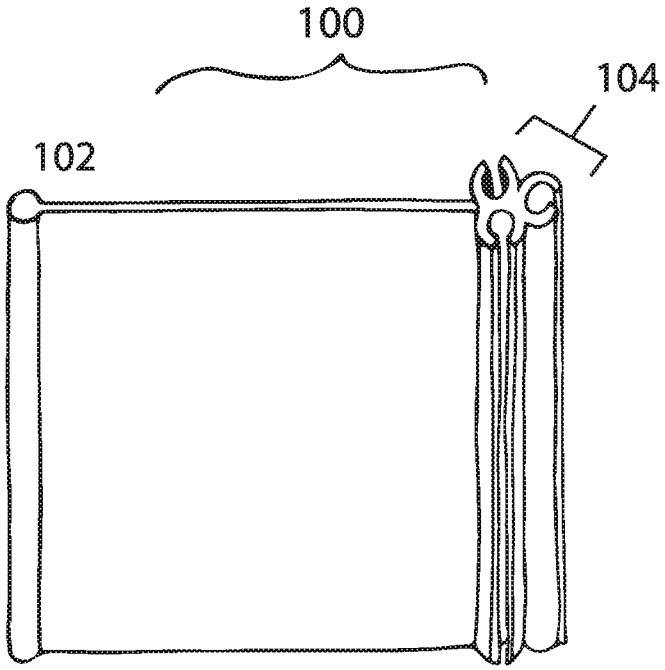
FIG. 1 illustrates an example toy building piece having an open multi-cylindrical endpiece.

A new toy building set having building blocks with a base, a first end piece and a second end piece is disclosed herein. FIG. 1 illustrates an example toy building piece 100 having an open multi-cylindrical end piece. The first end piece 102 is a singular, closed cylindrical tube, the base is a rectangular piece 106 and the second end piece 104 is a set of three open cylindrical tubes. In this example, the set contains three open cylindrical tubes. A first building block attaches to a second building block by sliding the first end piece of the first building block into one of a set of one or more open cylindrical tubes of a second end piece of the second building block. The second end piece can receive at least one closed end piece from another building block. For example, the second end piece can receive two building blocks when the end piece has at least two open cylindrical tubes.

Additionally, the second end piece can receive three building blocks when the end piece has at least three open cylindrical tubes. The first end piece and the second end piece are permanently attached to the base, which in this example, is of a rectangular shape. Any shape is contemplated for the base such as a square, triangle or hexagon. The base can have a zig-zag or waving shape as long as it is a part of a block that has end pieces to allow it to connect with other blocks. Customized pieces can include a base in the shape of a letter, arch or castle. In each case, the base shape can have a first end piece and a second end piece permanently attached. The heights of the first end piece, the second end piece and the base can be the same to allow for proper fitting of a first end piece into a second end piece. Alternately, the heights of the first end piece and the second end piece can be the same, with a differing base height. In another example, heights of a first end piece and a second end piece can differ, to accommodate a slope of the base shape.

The angles at which open cylindrical tubes are attached to its base can vary, for example 90 degrees, 180 degrees and 270 degrees to create right angles when attached with a second piece. In another example, open cylindrical tubes can be attached to its base shape at 90 degrees and 270 degrees. Alternately, a piece can have one open cylindrical tube attached to its base shape at 180 degrees. In these examples, degrees in relation to a base shape refers to the angle of the narrow opening in an open cylindrical tube.

Figure 2:
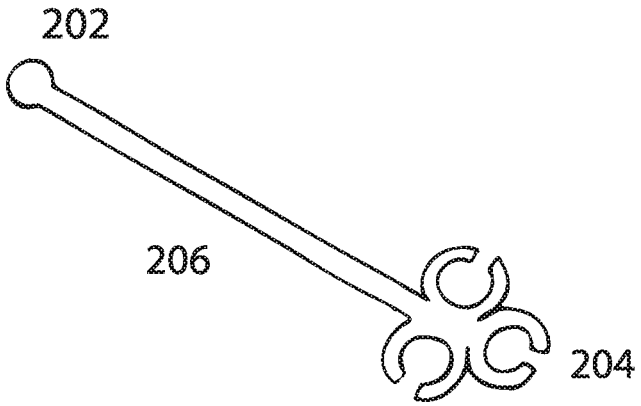
FIG. 2 illustrates an example top view of a toy building piece having an open multi-cylindrical endpiece.

FIG. 2 illustrates a top view of a toy building piece having an open multi-cylindrical end piece. From this view, a first end piece 202 illustrates that it is closed, while the second end piece 204 has three open cylindrical tubes. The diameters of each of the open cylindrical tubes 204 are equivalent and the diameter of the closed cylindrical tube 202 is less than the diameters of the open cylindrical tubes, such that it allows a snug fit when a closed cylindrical tube is slid into one of the open cylindrical tubes of a second piece. The fit can allow pieces to easily be manipulated by a child, yet allow for the structural integrity of a dollhouse.

Figure 3:
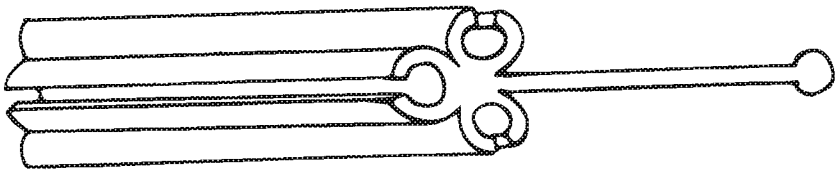
FIG. 3 illustrates an example end view of a toy building piece having an open multi-cylindrical endpiece.

FIG. 3 illustrates an example end view of a toy building piece having an open multi-cylindrical end piece. This view illustrates that a narrow opening 302 extends the length of the tube, and has a consistent width to allow for a proper fit with an adjoining second toy building piece. If the opening is too wide in relation to a base width of a second toy building piece, the second toy building piece will easily slide out and a structure will not stay together. If the opening is too narrow, pieces will not fit together properly.

Figure 4:
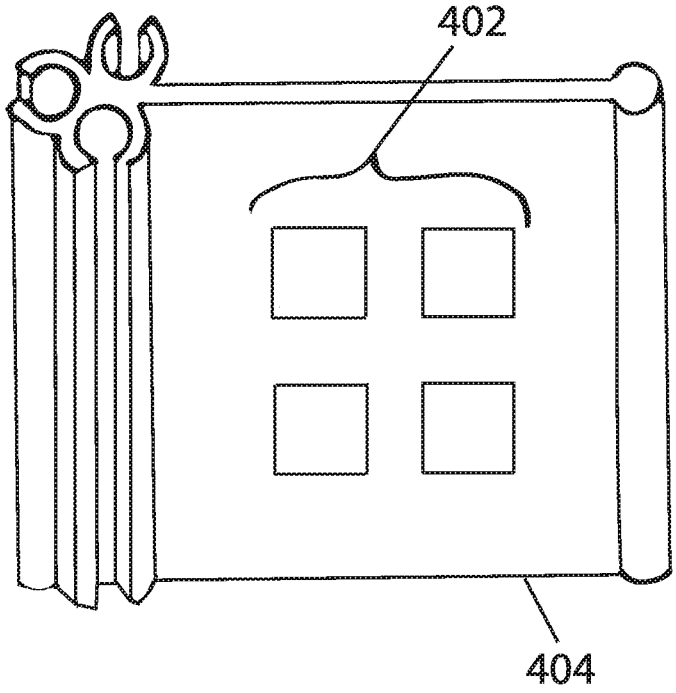
FIG. 4 illustrates a toy building piece having a window cutout.

FIG. 4 illustrates an example toy building piece having a window cutout 402 in a base 404. The window cutout piece allows a child to build a dollhouse having one or more windows. In another example, a toy building piece can have a door cutout, with an accompanying door on hinges that opens and closes to allow for more realistic play. Additionally, a toy building piece can have one or more cut out shapes such as a square, rectangle, circle, star and heart. Any combination of cut out shapes in a base of a toy building piece is contemplated.

Figure 5:
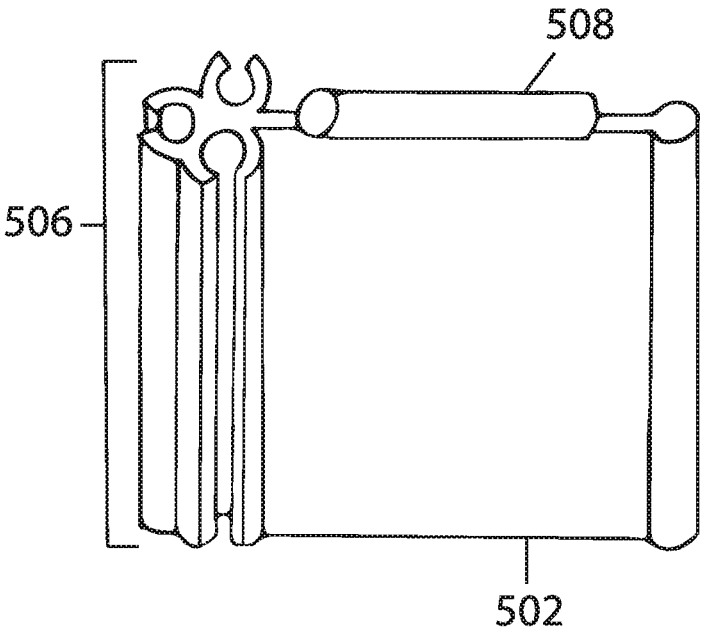
FIG. 5 illustrates an example toy building block having a top piece.

FIG. 5 illustrates an example toy building block having a base 502, a first end piece 504, a second end piece 506 and a top piece 508. The top piece 508 can be a closed cylindrical tube, such that a second building block can attach to a first block along the top piece of the building block, with the bases having a 90-degree angle. Having an attached top piece 508 allows for increased imagination and flexibility in building dollhouses, for example. A house structure often has more than one level, so having a block with a top piece enables and encourages multi-level structure building.

Figure 6:
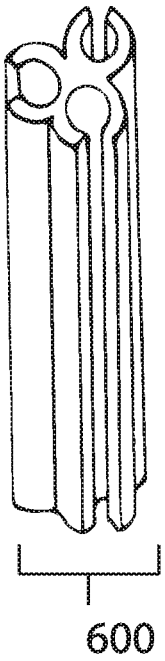
FIG. 6 illustrates an alternate toy building block having cylindrical tubes.

FIG. 6 illustrates an example toy building block that is a set of open cylindrical tubes 600. This block has only open cylindrical tubes, without a base or accompanying closed end piece. This block can be thought of as a detached end piece to allow for more flexibility in building. For example, two basic building blocks can be joined together using the set of open cylindrical tubes 600 and each of the respective closed end pieces from a basic building block 504.

Figure 7:
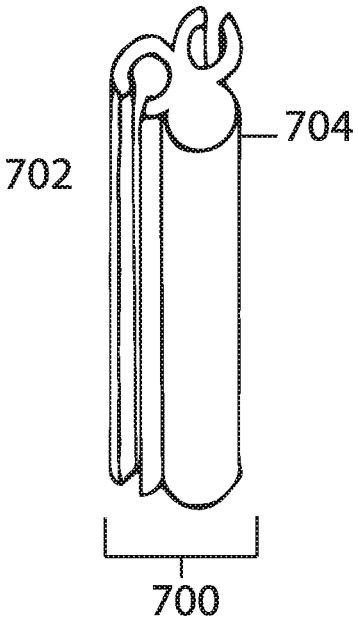
FIG. 7 illustrates an alternate toy building block.

FIG. 7 illustrates an alternate set of cylindrical tubes 700 such that it includes a combination of open 702 and closed cylindrical tubes 704. Any combination of cylindrical tubes is contemplated, for example two open and one closed tube or one open and three closed tubes. Additionally, a building block containing only closed cylindrical tubes is possible to allow for more flexible joining of basic building blocks 100.

In one example, the shape of tubing 102, 104 is different than the basic cylindrical shape. A rectangular, triangular or hexagonal shaping is possible for more varied building blocks. It is important to note that when alternate tube shaping is utilized, when attaching blocks together the shape of the closed tube must be the same as the shape of the open tube receiving the closed tube to allow for a proper, snug fit. Any combination of shapes within a set of open tubes is possible.

Figure 8:
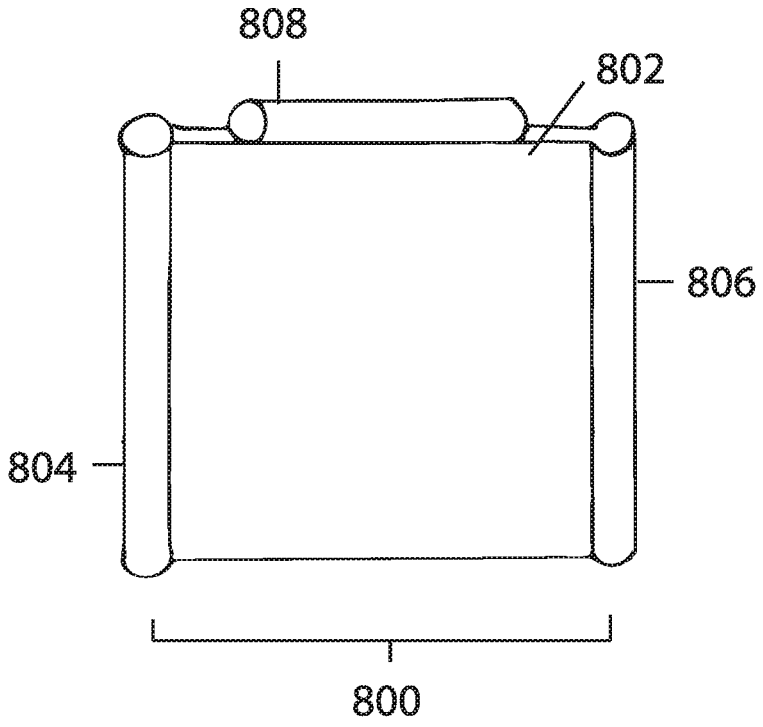
FIG. 8 illustrates an alternate toy building block.

FIG. 8 illustrates an alternate toy building block 800 having a rectangular base 802, a first endpiece having a closed cylindrical tube 804, a second endpiece having a closed cylindrical tube 806 and a top end piece having a closed cylindrical tube 808. This alternate block 800 can be used in different ways to allow for flexible dollhouse building. Two alternate blocks 800 can be used in conjunction with block 600 (a set of open cylindrical tubes) to create walls or a multi-level dollhouse.

Figure 9:
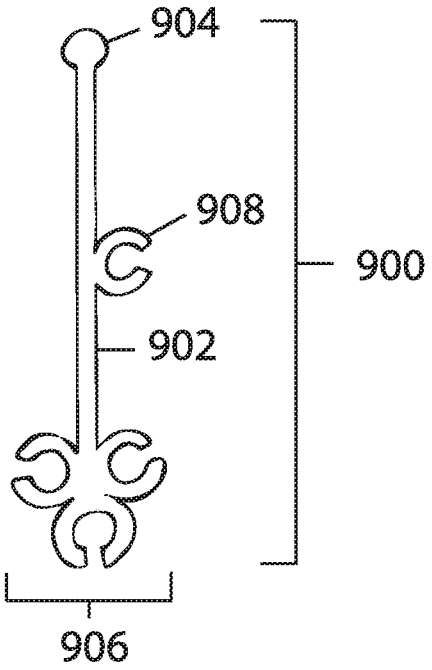
FIG. 9 illustrates an alternate toy building block.

FIG. 9 illustrates a top view of an alternate toy building block 900 having a rectangular base 902, a first endpiece having a closed cylindrical tube 904, a second endpiece having a set of open cylindrical tubes 906 and a single, open cylindrical tube 908 that attaches to the base near the center. The tube 908 can be attached at any point along the base such that it can receive a block having a closed cylindrical tube. Alternately, tube 908 can be a closed cylindrical tube such that it can receive a block having an open cylindrical tube.

Figure 10:
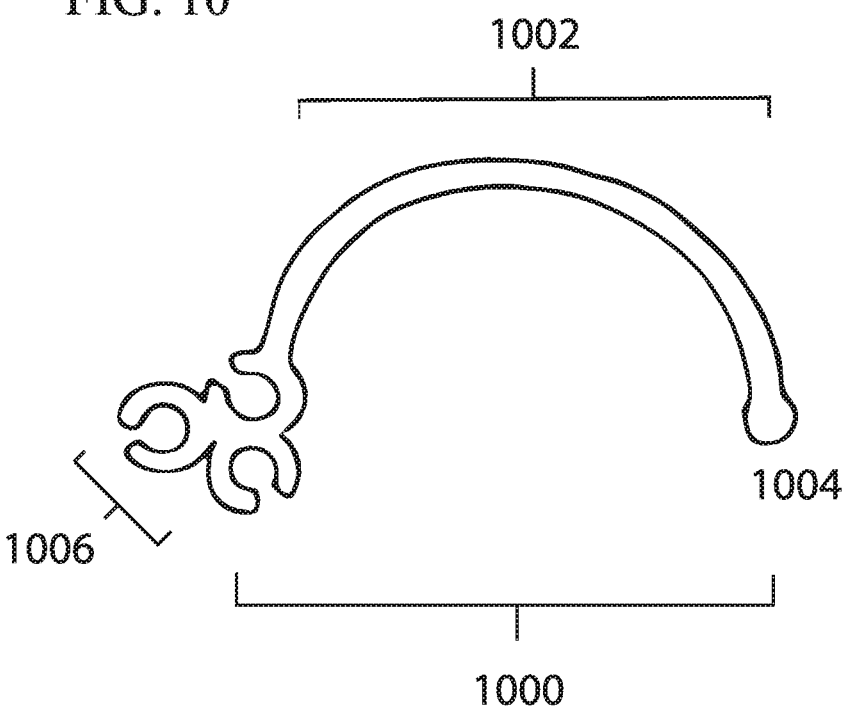
FIG. 10 illustrates an alternate toy building block.

FIG. 10 illustrates a top view of an alternate toy building block 1000 having a curved base 1002, a first endpiece having a closed cylindrical tube 1004 and a second end piece having a set of open cylindrical tubes 1006. The unique shape of the base allows for connecting with other blocks having either a curved base or the standard rectangular base. Tunnels and turrets are a few of the structures that can be built with blocks having a curved base. Other base shapes are contemplated such as zigzag or wavy, for example.

A toy building block 100 can be made from a lightweight, durable plastic such that it does not bend when manipulated. Other materials are contemplated such as a lightweight wood such as balsa that does not easily break. The material can be textured for visual appeal and also allowing for increased sensory play. Textures such as wood grain, brick or siding can be used. Combinations of materials can be used in the fabrication of toy building pieces such as a plastic piece having a magnetic base component. A plastic piece with a magnetic base component would facilitate connecting a toy building piece having an open multi-cylindrical end piece with another toy building set such as Magformers, for example. In yet another example, a plastic toy building piece can have multiple round protrusions from the base, to allow connecting with Lego toy pieces. In this way, the building set disclosed herein can connect with other, existing toy building sets.

The various embodiments described above are provided by way of illustration only and should not be construed to limit the scope of the disclosure. Various modifications and changes may be made to the principles described herein without following the example embodiments and applications illustrated and described herein, and without departing from the spirit and scope of the disclosure.

I claim:

1. A toy building set comprising:

a first building block having a rectangular base, a first end piece and a second end piece, wherein the first end piece is a closed cylindrical tube and the second end piece is comprised of a set of three open cylindrical tubes, wherein the first end piece and the second end piece of the first building block are rigid, stationary and permanently affixed to the base, wherein the first building block attaches to a second building block by sliding the first end piece of the first building block into one of a set of three open cylindrical tubes of a second end piece of the second building block, wherein the first end piece and the second end piece of the second building block are rigid, stationary and permanently affixed to the base.

2. The toy building set of claim 1, wherein the heights of the base, the first end piece and the second end piece are the same.

3. The toy building set of claim 1, wherein a first diameter is a diameter of the first end piece and a second diameter is a diameter of each of the three open cylindrical tubes.

4. The toy building set of claim 1, wherein each of the three open cylindrical tubes includes a narrow opening that extends the length of the cylindrical tube such that the opening is so dimensioned having a width that is narrower than the opening but wide enough to allow for a snug fit with the first end piece of the second building block.

5. The toy building set of claim 1, further comprising a third building block having a rectangular base, a first end piece, a second end piece and a top piece wherein the top piece is a closed cylindrical tube, the first end piece is a closed cylindrical tube and the second end piece is a set of three open cylindrical tubes, wherein each of the first end piece, the second end piece and the top piece of the third building block are rigid, stationary, and permanently affixed to the base.

6. The toy building set of claim 1, further comprising a fourth building block comprising a set of three open cylindrical tubes, wherein the tubes are rigid, stationary and permanently affixed together.

7. The toy building set of claim 1, wherein each of the three open cylindrical tubes is permanently and rigidly affixed to the base such that the narrow opening of each of the three open cylindrical tubes is one of ninety degrees, one hundred eighty degrees and two hundred seventy degrees in relation to the base.

8. The toy building set of claim 1, further comprising a fourth building block having a rectangular base, a first end piece and a second end piece, wherein the rectangular base includes cutouts.

9. The toy building set of claim 1, further comprising a sixth building block having a rectangular base, a first end piece, a second end piece and a center piece wherein the first end piece is a closed cylindrical tube, the second end piece is comprised of a set of three open cylindrical tubes and the center piece is an open cylindrical tube affixed permanently to the center of base.

10. The toy building set of claim 1, further comprising a seventh building block having a curved base, a first end piece and a second end piece, wherein the first end piece is a closed cylindrical tube, the second end piece is comprised of a set of three open cylindrical tubes.

* * * * *